US008167389B2

(12) United States Patent
Han et al.

(10) Patent No.: US 8,167,389 B2
(45) Date of Patent: May 1, 2012

(54) REFRIGERATOR MULLION WITH PROTECTION UNIT

(75) Inventors: Jae Myung Han, Gwangsan-gu (KR); Gi Joong Jeong, Buk-gu (KR); Jeong Man Nam, Gwangsan-gu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 287 days.

(21) Appl. No.: 12/585,241

(22) Filed: Sep. 9, 2009

(65) Prior Publication Data

US 2010/0071404 A1 Mar. 25, 2010

(30) Foreign Application Priority Data

Sep. 25, 2008 (KR) ..... 10-2008-0094115
Jul. 28, 2009 (KR) ..... 10-2009-0068678

(51) Int. Cl.
*A47B 96/04* (2006.01)
*E05D 11/00* (2006.01)

(52) U.S. Cl. ..... 312/405; 16/250

(58) Field of Classification Search ..... 312/405, 312/296, 319.2, 326, 329; 16/250, 251, 229; 49/475.1, 478.1, 480.1; 411/403
See application file for complete search history.

(56) References Cited

U.S. PATENT DOCUMENTS 3,045,663 A * 7/1962 McDonnold ..... 126/190
3,972,636 A * 8/1976 Peter et al. ..... 403/374.4
4,711,098 A * 12/1987 Kuwabara et al. ..... 62/441
5,411,328 A * 5/1995 You ..... 312/405
5,694,789 A * 12/1997 Do ..... 62/441
5,870,801 A * 2/1999 Kim ..... 16/382
6,119,307 A * 9/2000 Weishar et al. ..... 16/87 R
6,205,616 B1 * 3/2001 Hwang ..... 16/229
6,945,621 B2 * 9/2005 Shin ..... 312/405
7,726,756 B2 * 6/2010 Fu ..... 312/405
2001/0017508 A1 * 8/2001 Caldwell et al. ..... 312/326
2003/0071549 A1 * 4/2003 Tarantik ..... 312/405
2004/0207304 A1 * 10/2004 Cho ..... 312/405
2005/0046319 A1 * 3/2005 Chekal et al. ..... 312/401
2006/0244351 A1 * 11/2006 Moon et al. ..... 312/405
2007/0257589 A1 * 11/2007 Laible ..... 312/405
2009/0179540 A1 * 7/2009 Seo ..... 312/405
2009/0273264 A1 * 11/2009 Butler ..... 312/405

FOREIGN PATENT DOCUMENTS

JP 06-042859 2/1994
KR 10-0602218 7/2006

* cited by examiner

*Primary Examiner* — Darnell Jayne
*Assistant Examiner* — Andrew Roersma
(74) *Attorney, Agent, or Firm* — Staas & Halsey LLP

(57) ABSTRACT

A refrigerator, which prevents a filler unit from being worn away or broken. The refrigerator includes a main body, storage chambers divisionally provided in the main body, a pair of doors opening and closing one of the storage chambers, a filler unit rotatably connected to at least one of the pair of doors to seal a separation space between the doors, a guide member provided on the main body to guide rotation of the filler unit, and a protection unit mounted on the filler unit to rotate the filler unit according to insertion and separation of the protection unit into and from the guide member and to prevent the breakage of the filler unit due to collision with the guide member.

4 Claims, 10 Drawing Sheets

REFRIGERATOR MULLION WITH PROTECTION UNIT

CROSS-REFERENCE TO RELATED APPLICATIONS

This application claims the benefit of Korean Patent Application Nos. 2008-0094115, filed on Sep. 25, 2008, and 2009-0068678, filed on Jul. 28, 2009, in the Korean Intellectual Property Office, the disclosures of which are incorporated herein by reference.

BACKGROUND

1. Field

Embodiments of the present invention relate to a refrigerator, which has a filler unit rotatably connected to one cooling chamber door to seal a separation space between right and left cooling chambers when the cooling chamber doors are closed.

2. Description of the Related Art

In general, refrigerators cool or freeze foods stored therein according to the principle of a refrigerating cycle. One example of a refrigerator is, a bottom mount freezer (BMF). The BMF includes a freezing chamber provided in the lower portion of a main body and a cooling chamber provided above the freezing chamber.

In the above BMF type refrigerator, a pair of cooling chamber doors is provided, and a filler unit to prevent the leakage of cold air through a separation space between the cooling chamber doors when the cooling chamber doors are closed is rotatably connected to one of the two cooling chamber doors.

A guide unit corresponding to the filler unit is provided on the upper portion of the cooling chamber.

Therefore, when the cooling chamber door with the filler unit is closed, the filler unit is rotated to the cooling chamber door without the filler unit along the guide unit and closes a separation space between the pair of the cooling chamber doors to prevent the leakage of cold air. When the cooling chamber door with the filler unit is opened, the filler unit is rotated to the cooling chamber along the guide unit and facilitates the opening of the cooling chamber door with the filler unit.

Here, when the cooling chamber door is opened, the filler unit may maintain a rotated state relative to the side surface of the cooling chamber door due to a malfunction of the cooling chamber door when the cooling chamber door is opened or closed, or due to a user's behavior. When the cooling chamber door with the filler unit is closed in the above state, the filler unit may be worn away or broken due to the collision with the outer surface of the guide unit. When the filler unit is broken, the entire filler unit needs to be replaced.

SUMMARY

Therefore, it is one aspect of the present invention to provide a refrigerator, which prevents a filler unit from being worn away or broken.

It is another aspect of the present invention to provide a refrigerator, which allows a broken filler unit to be repaired only by replacing a part of the filler unit rather than replacing the entire filler unit.

Additional aspects and/or other advantages of the invention will be set forth in part in the description which follows and, in part, will be apparent from the description, or may be learned by practice of the invention.

The foregoing and/or other aspects of the present invention may be achieved by providing a refrigerator including a main body, a plurality of storage chambers in the main body, a pair of doors opening and closing one of the storage chambers, a filler unit rotatably connected to at least one of the pair of doors to seal a separation space between the pair of doors, a guide member on the main body to guide rotation of the filler unit, and a protection unit on the filler unit to rotate the filler unit according to insertion and separation of the protection unit into and from the guide member and to prevent the breakage of the filler unit due to collision with the guide member.

A protrusion may be formed integrally with one side of the filler unit, and the protection unit may include a cover to surround the outer surface of the protrusion. The cover may be detachably connected to the protrusion.

The protection unit may further include a screw to detachably connect the cover to the protrusion. The cover may be made of a material having a self-lubricating function. The protection unit may include a protrusion ascending and descending against the filler unit and inserted into and taken out of the guide member. The protection unit may further include an elastic member to elastically support the protrusion in the ascending and descending direction of the protrusion.

The pair of doors may include a first door and a second door, the filler unit may be mounted on the first door, and be rotatable between the direction of the second door and the direction of the one of the storage chambers. When the first door is closed if the filler unit is rotated in the direction of the second door, the protrusion descends by the guide member and then is inserted into the guide member.

The protrusion may be provided with a slope inclined downward to the storage chambers. The protection unit may include a boss inserted into and separated from the guide member. The protection unit may further include a screw to fix the boss to the upper portion of the filler unit. A seat part, on which the boss is mounted, may be provided on the upper end of the filler unit.

The foregoing and/or other aspects of the present invention may be achieved by providing a refrigerator including a main body divided into a cooling chamber at an upper part of the main body and a freezing chamber at a lower part of the main body, a pair of doors opening and closing the cooling chamber, a filler unit rotatably connected to at least one of the pair of doors to prevent the leakage of cold air in the cooling chamber to an outside of the cooling chamber, a guide member provided on the main body to guide the rotation of the filler unit, and a protection unit provided on the filler unit corresponding to the guide member to prevent the breakage of the filler unit.

The protection unit may include a protrusion being movable against the filler unit, and an elastic member to elastically support the protrusion in the protruding direction of the protrusion. The filler unit may be provided with a protrusion hole to receive the protrusion, and the protrusion may ascend and descend along the protrusion hole.

The protrusion may be provided with a slope inclined downward to the cooling chamber. A protrusion may be formed integrally with one side of the filler unit, and the protection unit may include a cover to surround the outer surface of the protrusion. The protection unit may include a boss inserted into and separated from the guide member, and a screw to fix the boss to the upper portion of the filler unit. A seat part, on which the boss is mounted, may be provided on the upper end of the filler unit.

BRIEF DESCRIPTION OF THE DRAWINGS

These and/or other aspects and advantages will become apparent and more readily appreciated from the following description of the embodiments, taken in conjunction with the accompanying drawings in which.

DETAILED DESCRIPTION OF EMBODIMENTS

Figure 1:
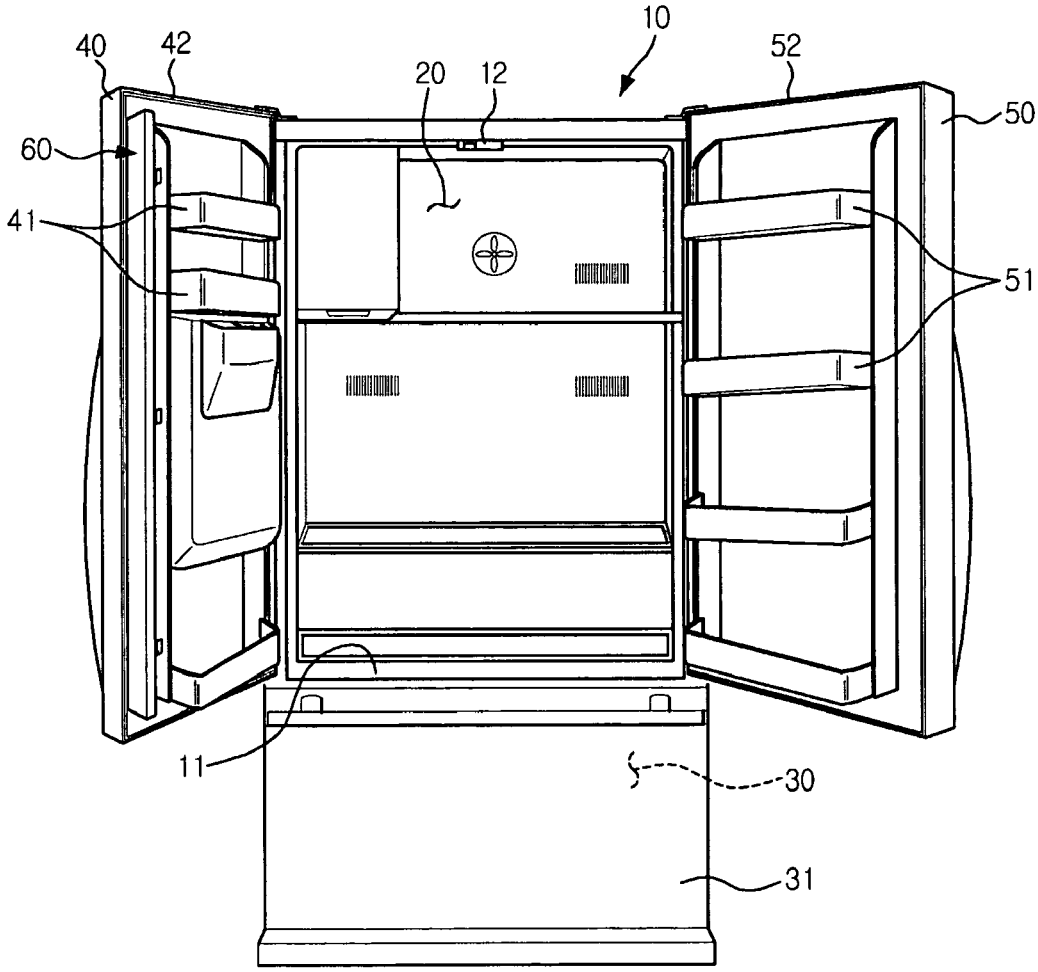
FIG. 1 is a perspective view illustrating the overall appearance of a refrigerator in accordance with one embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

Figure 2:
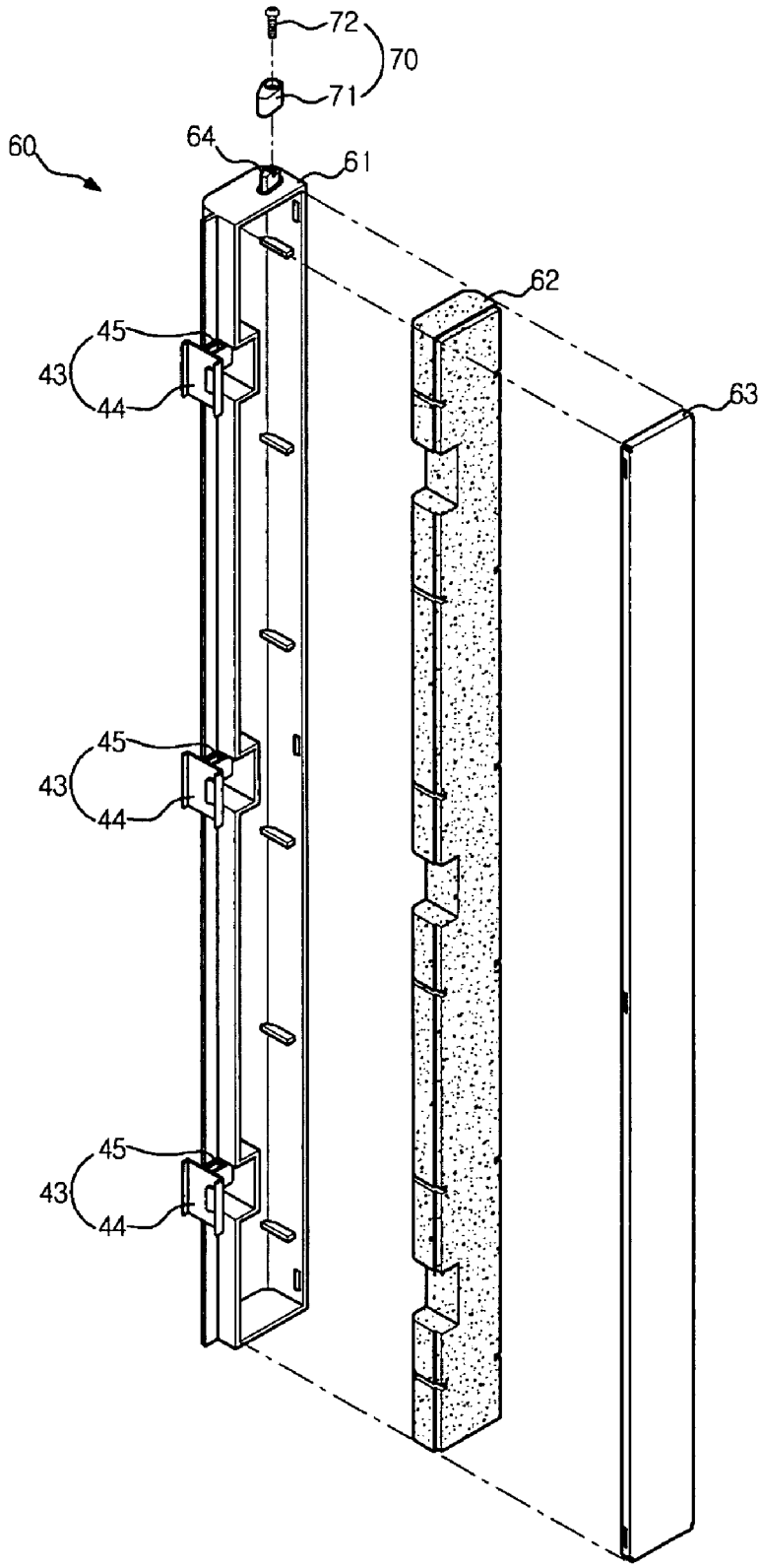
FIG. 2 is an exploded perspective view illustrating a filler unit and a protection unit of the refrigerator in accordance with the embodiment of the present invention.
Figure 3:
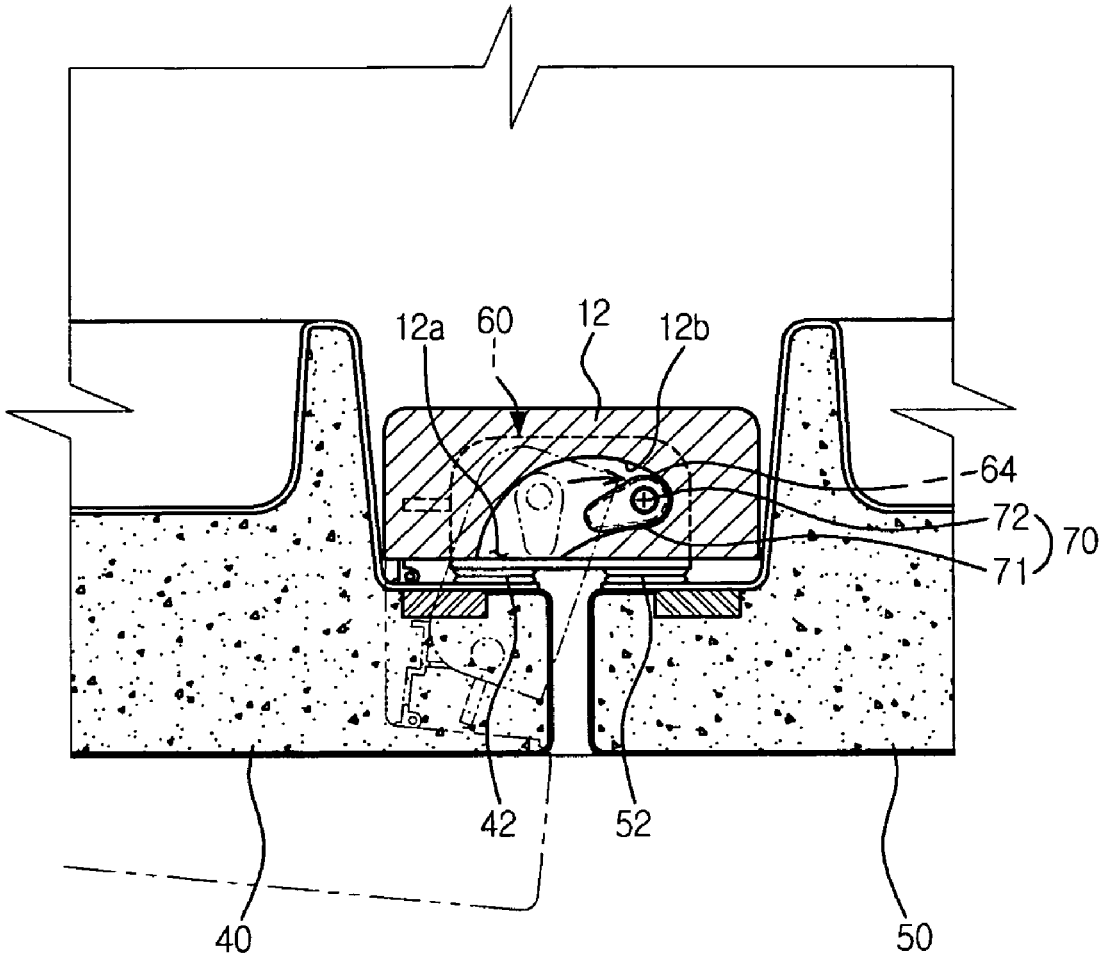
FIG. 3 is a sectional view illustrating the operation of the filler unit of the refrigerator in accordance with the embodiment of the present invention.

FIG. 1 is a perspective view illustrating the overall appearance of a refrigerator in accordance with one embodiment of the present invention, FIG. 2 is an exploded perspective view illustrating a filler unit and a protection unit of the refrigerator in accordance with the embodiment of the present invention, and FIG. 3 is a sectional view illustrating the operation of the filler unit of the refrigerator in accordance with the embodiment of the present invention.

Figure 4:
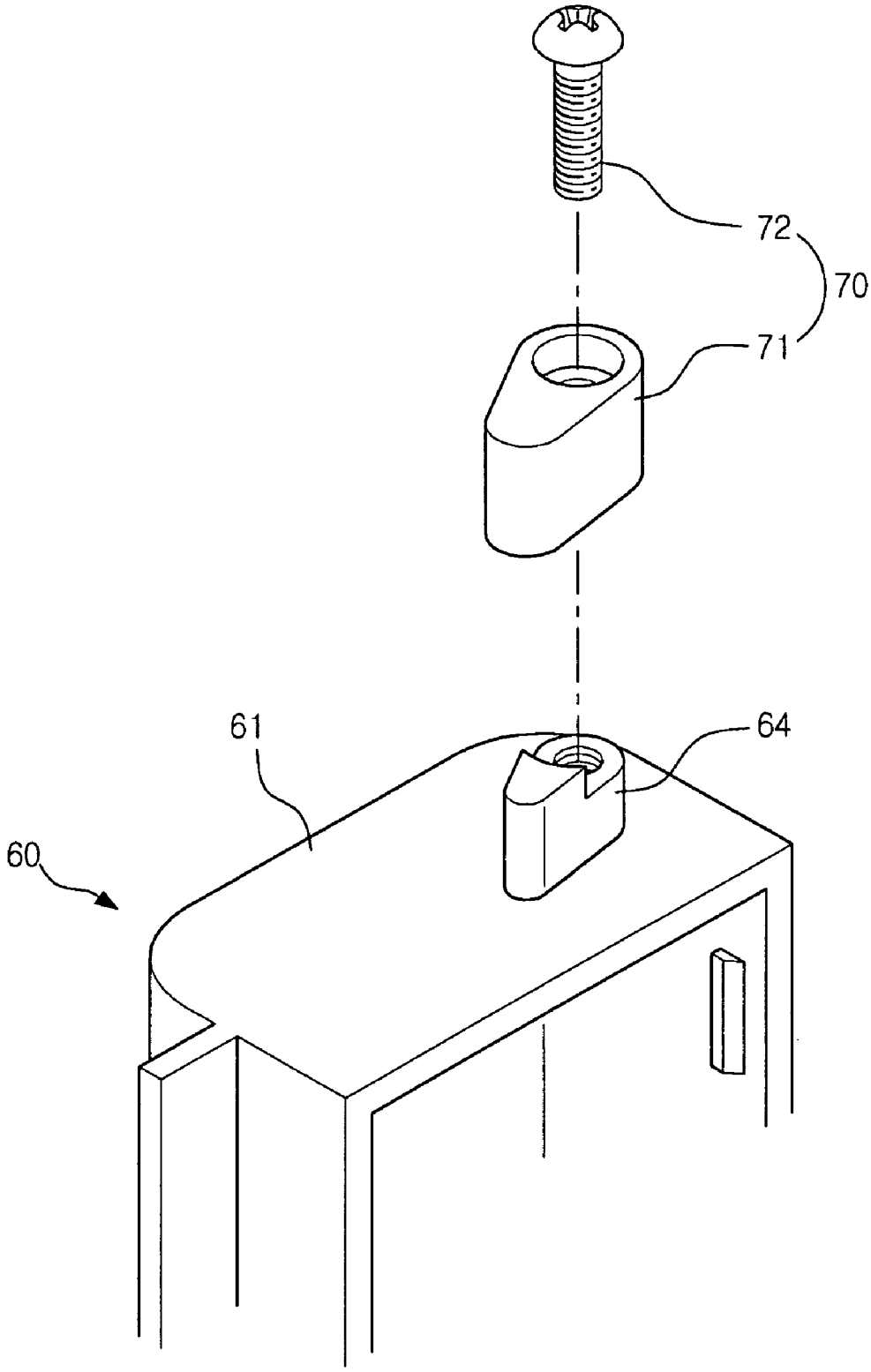
FIG. 4 is an enlarged view of a portion of FIG. 2.
Figure 5:
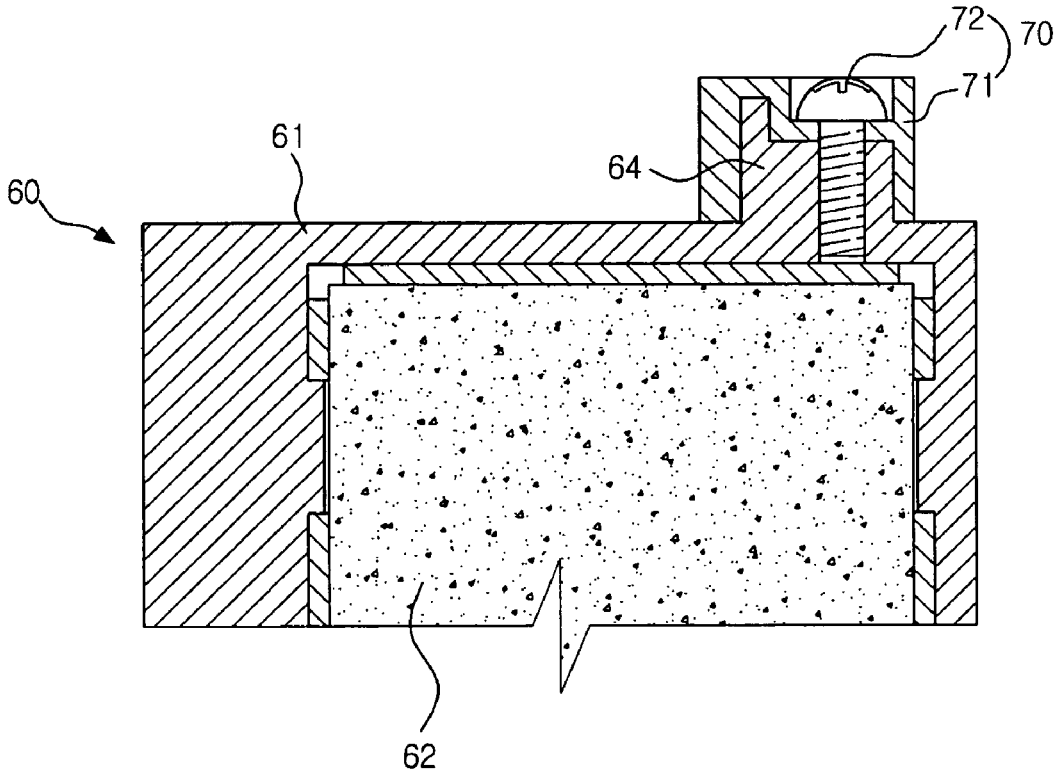
FIG. 5 is a sectional view illustrating the connection state of the filler unit and the protection unit of the refrigerator in accordance with the embodiment of the present invention.

FIG. 4 is an enlarged view of an essential portion of FIG. 2, and FIG. 5 is a sectional view illustrating the connection state of the filler unit and the protection unit of the refrigerator in accordance with the embodiment of the present invention.

The refrigerator in accordance with this embodiment, as shown in FIG. 1, includes a main body 10 forming the external appearance of the refrigerator, storage chambers 20 and 30 vertically divided in the main body 10 and respectively provided with opened front surfaces, and doors 31, 40, and 50 opening and closing the opened front surfaces of the storage chambers 20 and 30.

A machinery chamber (not shown) is separately provided in the rear region of the lower portion of the main body 10. Electric parts including a compressor (not shown) are installed in the machinery chamber, and parts including an evaporator (not shown), a condenser (not shown), and an expansion device (not shown) forming a refrigerating cycle are provided in the main body 10.

A gap between an inner case and an outer case of the main body 10 is filled with a foaming agent to maintain the insulation of the inside of the refrigerator.

The storage chambers 20 and 30 include a cooling chamber 20 provided in the upper part of the inside of the main body 10 to store foods in a cold state, and a freezing chamber 30 provided in the lower part of the inside of the main body 10 to store foods in a frozen state. Here, the cooling chamber 20 and the freezing chamber 30 are vertically divided from each other by a horizontal diaphragm 11.

The doors 31, 40, and 50 are provided to respectively open and close the freezing chamber 30 and the cooling chamber 20, and include a pair of cooling chamber doors 40 and 50, ends of which are rotatably connected to the main body 10 to open and close the cooling chamber 20, and a drawer type freezing chamber door 31 slidably connected to the main body 10 to open and close the freezing chamber 30.

A plurality of door racks 41 and 51 to store food are respectively installed on the rear surfaces of the cooling chamber doors 40 and 50, and gaskets 42 and 52 to prevent the leakage of cold air through gaps between the main body 10 and the cooling chamber doors 40 and 50 when the cooling chamber doors 40 and 50 are closed are installed at the edges of the rear surfaces of the cooling chamber doors 40 and 50.

Further, the other ends of the cooling chamber doors 40 and 50 are separated from each other by a designated distance so as to respectively form rotation spaces, in which the cooling chamber doors 40 and 50 are smoothly rotated.

A filler unit 60 is installed on at least one cooling chamber door of the pair of the cooling chamber doors 40 and 50 to prevent the cold air in the cooling chamber 20 from being exhausted to the outside through the separation space between the pair of the cooling chamber doors 40 and 50.

Although this embodiment illustrates the filler unit 60 rotatably installed on the left cooling chamber door 40, as shown in FIG. 1, the filler unit 60 may be rotatably installed on the right cooling chamber unit 50.

Hereinafter, for convenience of description, the left cooling chamber door 40 is referred to as a first door, and the right cooling chamber door 50 is referred to as a second door.

The filler unit 60 is formed in a bar shape, which is vertically extended, as shown FIG. 2. The filler unit 60 includes a case 61 having a hollow structure, a heat insulator 62 filling the inside of the case 61, and a connection part 63 closing the case 61 and connected to the gaskets 42 and 52 of the first and second doors 40 and 50.

The filler unit 60 is rotatably installed on the rear surface of the other end of the first door 40. When the first door 40 closes the left portion of the cooling chamber 20, the filler unit 60 is rotated in the direction of the second door 50, enters the rear portion of the other end of the second door 50, and thus contacts the gasket 52 of the second door 50.

Therefore, the filler unit 60 seals the space between the pair of the cooling chamber doors 40 and 50, and prevents the cold air in the cooling chamber 20 from leaking to the outside through the separation space between the pair of the cooling chamber doors 40 and 50.

In order to rotatably install the filler unit 60 at the other end of the first door 40, hinge brackets 43 are installed on the rear surface of the first door 40. Each of the hinge brackets 43 includes a fixing part 44 having a designated area and fixed to the first door 40, and a hinge part 45 extended integrally from the fixing part 44 and provided with a front end, at which the filler unit 60 is rotatably installed.

A guide member 12 (with reference to FIGS. 1 and 3) corresponding to the filler unit 60 is provided at the upper end of the center of the main body 10. The guide member 12 includes an opening 12*a* formed at a position corresponding to the upper end of the filler unit 60 such that the upper end of the filler unit 60 is inserted into and taken out of the opening 12*a*, and a guide slot 12*b* extended from the opening 12*a* to guide the movement of the upper end of the filler unit 60 such that the filler unit 60 is rotated.

Therefore, when the first door 40 is closed, as shown in FIG. 3, the upper end of the filler unit 60 is inserted into the opening 12*a* of the guide member 12 and is guided along the guide slot 12*b*, and thus the filler unit 60 is rotated toward the second door 50. When the first door 40 is opened, the upper end of the filler unit 60 is guided along the guide slot 12*b*, and thus the filler unit 60 is guided toward the cooling chamber 20.

A protrusion 64 is formed integrally with the upper end of the filler unit 60. The protrusion 64 is guided by the guide member 12, and thus the above rotating operation of the filler unit 60 is achieved.

When the cooling chamber doors 40 and 50 are used for a long time, a protrusion of a conventional filler unit may be worn away due to the contact with the guide member or be broken due to an excessive impact during the use of the cooling chamber doors 40 and 50. In this case, the entire filler unit needs to be replaced. In order to prevent the replacement of the entire filler unit 60, the refrigerator in accordance with this embodiment includes a protection unit 70 to prevent the breakage of the filler unit 60.

The protection unit 70 includes a cover 71 surrounding the outer surface of the protrusion 64, and a screw 72 to fix the cover 71 to the protrusion 64.

Although this embodiment exemplarily describes the screw 72 to fix the cover 71 to the protrusion 64, a hook or other various units to detachably connect the cover 71 to the protrusion 64 may be used.

The cover 71 has a hollow structure to accommodate the protrusion 64, and is detachably connected to the protrusion 64.

The cover 71 is made of a material having a self-lubricating function, and thus reduces wear due to the contact with the guide member 12.

Through the above configuration, the mounting of the protection unit 70 on the filler unit 60 is completed by inserting the cover unit 71 into the protrusion 64 of the filler unit 60 and fixing the cover 71 to the protrusion 64 using the screw 72.

Therefore, the protrusion 64 and the protection unit 70 mounted on the protrusion 64 move along the opening 12*a* and the guide slot 12*b* of the guide member 12, thus achieving the rotation of the filler unit 60.

Even if the cooling chamber doors 40 and 50 are used for a long time under the above condition, the wear of the cover 71 is reduced due to the self-lubricating function of the cover 71. Further, even if the cover 71 is worn away or broken, it is easy to provide a new cover. This wear or breakage may be due to the use of the cooling chamber doors 40 and 50 for a long time, or is due to the collision of the cover 71 with the outer surface of the guide member 12 when the first door 40 is closed when the filler unit 60 is rotated in the direction of the second door 50. To replace the cover 71, the worn or broken cover 71 is separated from the protrusion 64 by loosening the screw 72 and then a new cover 71 is inserted into the protrusion 64 and is fixed to the protrusion 64 using the screw 72. Thus, the durability of the filler unit 60 may be improved.

Now, a refrigerator in accordance with another embodiment of the present invention will be described.

Figure 6:
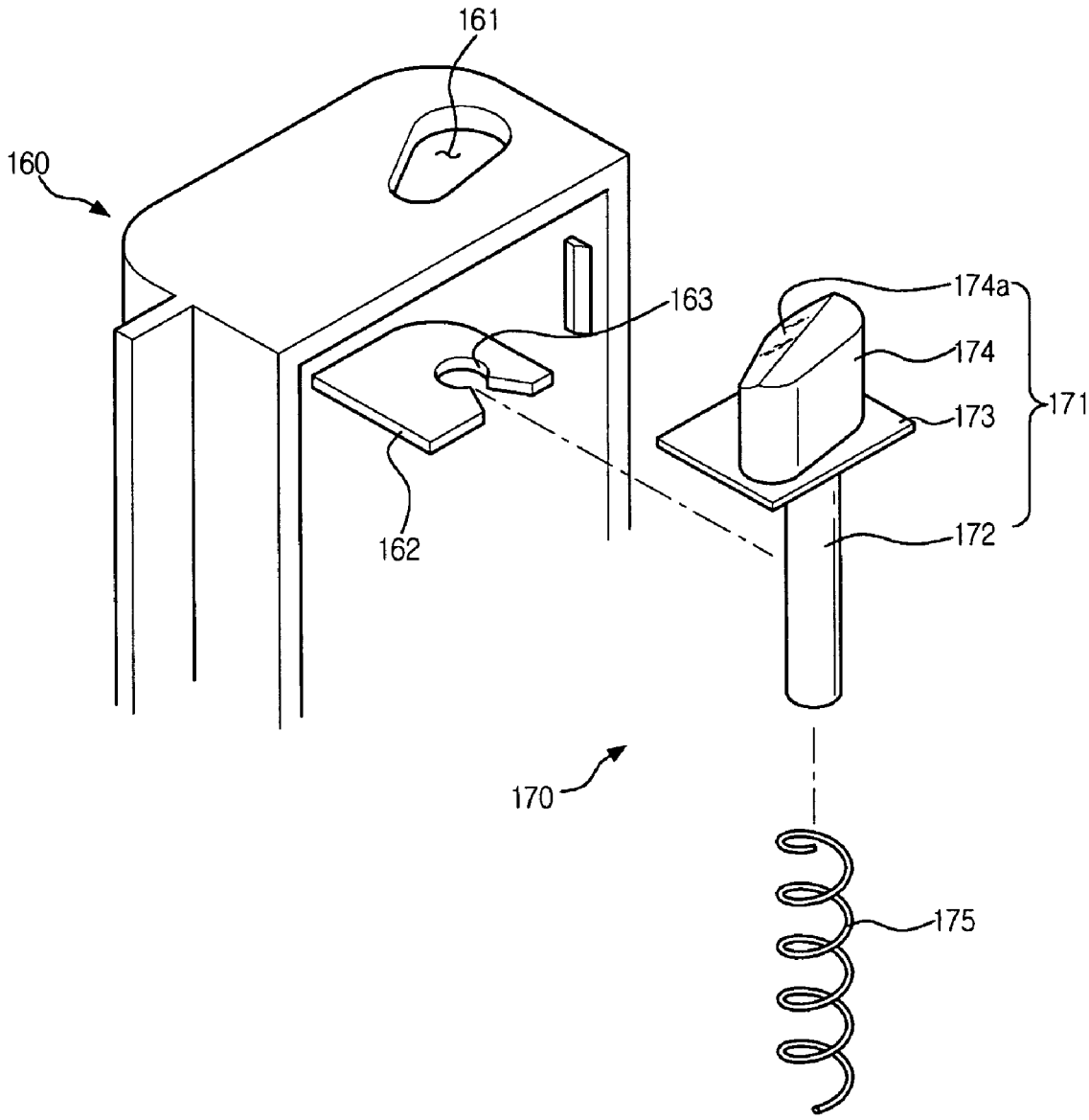
FIG. 6 is an exploded perspective view illustrating essential portions of a filler unit and a protection unit of a refrigerator in accordance with another embodiment of the present invention.
Figure 7:
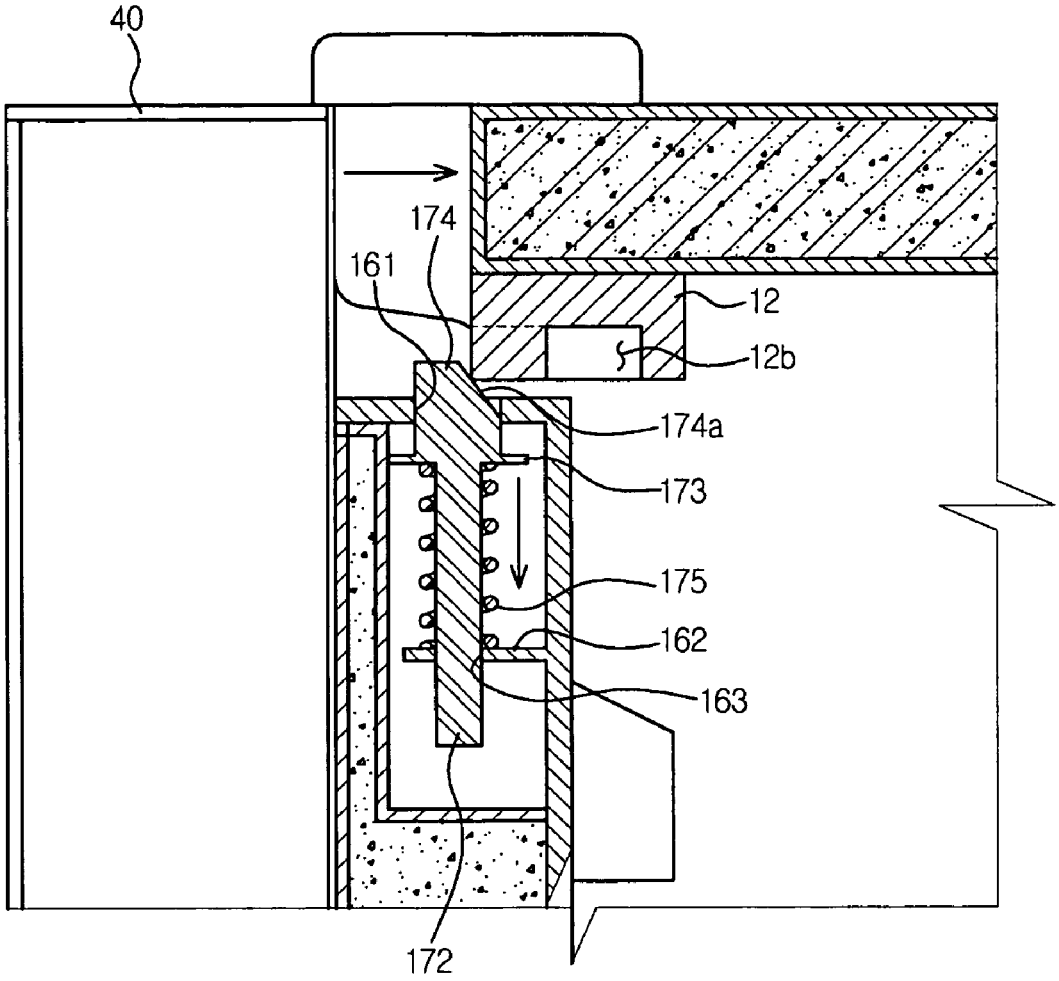
FIGS. 7 and 8 are sectional views illustrating the operation of the filler unit and the protection unit of the refrigerator in accordance with the embodiment of the present invention.
Figure 8:
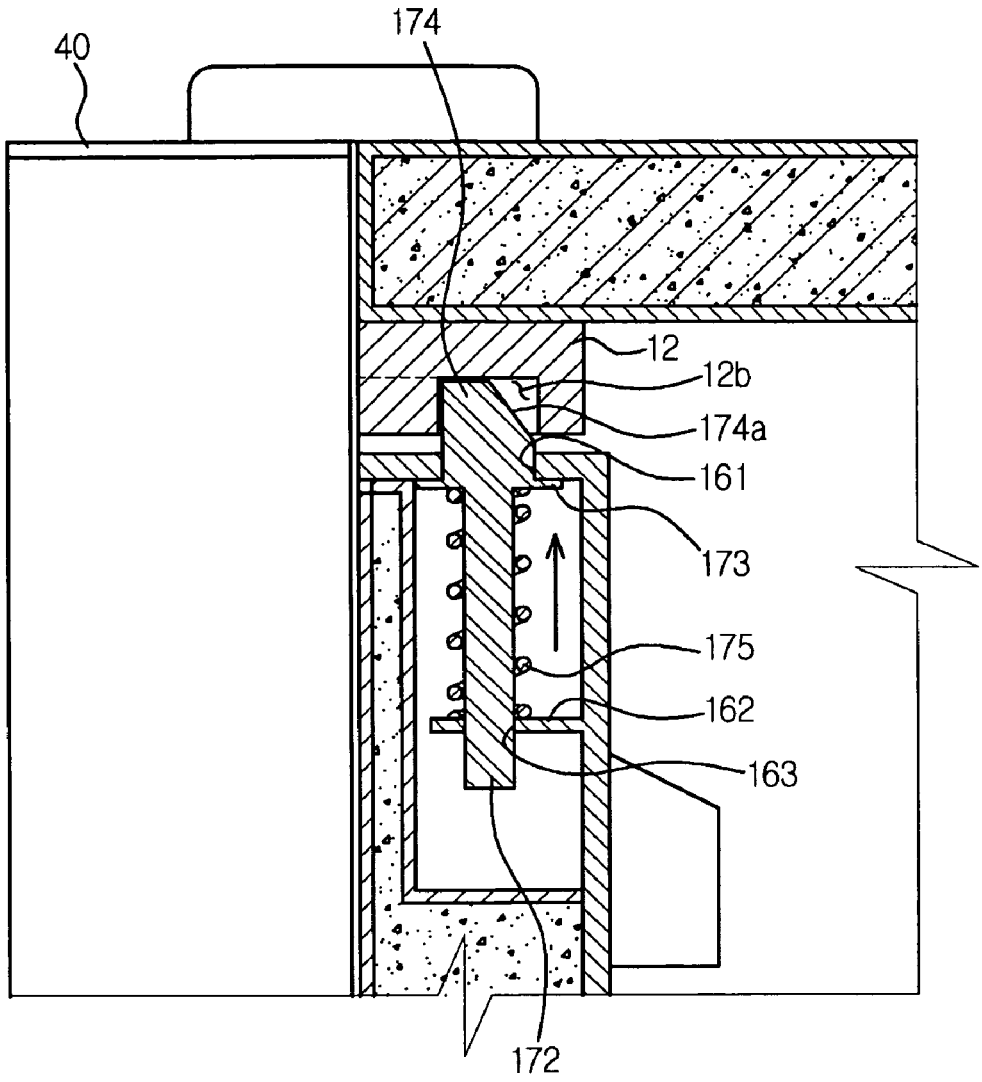

FIG. 6 is an exploded perspective view illustrating essential portions of a filler unit and a protection unit of the refrigerator in accordance with this embodiment, and FIGS. 7 and 8 are sectional views illustrating the operation of the filler unit and the protection unit of the refrigerator in accordance with this embodiment.

Parts of the refrigerator in this embodiment are the same as those of the refrigerator in the former embodiment except for some parts of the filler unit and the protection unit.

Hereinafter, only parts in this embodiment, which differ from those in the former embodiment, will be described, and parts in this embodiment, which are substantially the same as those in the former embodiment, are denoted by the same reference numerals and a detailed description thereof will thus be omitted.

The refrigerator in accordance with this embodiment, as shown in FIG. 6, further includes a filler unit 160 sealing a separation space between a pair of cooling chamber doors 40 and 50 to prevent the leakage of cold air in a cooling chamber 20 to the outside, and a protection unit 170 guiding the operation of the filler unit 160 to prevent the breakage of the filler unit 160.

The filler unit 160 having the same structure as that of the filler unit of the former embodiment is rotatably installed on the first door 40, and seals the separation space between the pair of the cooling chamber doors 40 and 50 in the same manner as that of the filler unit of the former embodiment.

A protrusion hole 161 is formed through the upper surface of the filler unit 160 of this embodiment, and guides the vertical movement of a protrusion 174 of the protection unit 170, which will be described later.

The protection unit 170 includes an elevating member 171 ascending and descending against the filler unit 160, and an elastic member 175 providing elastic force to the elevating member 171 in the ascending and descending direction.

The elevating member 171 includes a body 172, a stopper 173 formed at the upper portion of the body 172 to prevent the excessive protrusion of the elevating member 171, and the protrusion 174 formed at the upper surface of the stopper 173 and moving along the guide slot 12*b* of the guide member 12.

Although this embodiment exemplarily describes a coiled spring as the elastic member 175, other elastic members having various structures, which may provide elastic force to the elevating member 171 upward, may be used as the elastic member 175.

One end of the elastic member 175 is supported by the lower surface of the stopper 173, and the other end of the elastic member 175 is supported by a supporter 162 provided within the filler unit 160.

The supporter 162 has a plate structure provided with a reception part 163 therethrough to receive the body 172 such that the body 172 ascends and descends.

The stopper 173 has a plate structure having an area, that is larger than that of the protrusion hole 161.

When external force is not applied, and the elevating member 171 is pressed by the elastic member 175, the upper surface of the stopper 173 contacts the edge of the protrusion hole 161. Thus, it is possible to prevent the excessive protrusion of the elevating member 171.

The protrusion 174 is extended upward from the stopper 173, and is protruded from the upper surface of the filler unit 160 through the protrusion hole 161.

The protrusion 174 has a size, which approximately corresponds to the opening 12*a* (with reference to FIG. 3) of the guide member 12, and a downward slope 174*a* is formed on the surface of the protrusion 174 facing the guide member 12.

In the above configuration, the protrusion 174 maintains a protruded state unless external force is applied. Thus, when the filler unit 160 is rotated to the cooling chamber 20, when the first door 40 is closed, the protrusion 174 is inserted into the opening 12*a* of the guide member 12 and then moves along the guide slot 12*b*, and thus the filler unit 160 is rotated. When the first door 40 is opened, the protrusion 174 is guided along the guide slot 12*b*, and thus the filler unit 160 is rotated to the cooling chamber 20. Thereby, the opening and closing of the first door 40 is achieved.

When the first door 40 is closed when the filler unit 160 provided on the first door 40 is rotated in the direction of the second door 50 due to the malfunction of the filler unit 160 or by a user, the protrusion 174 maintaining the protruded state by the elastic member 175 is deviated from a position to be inserted into the opening 12*a* of the guide member 12. In this case, the protrusion 174 collides with the outer surface of the guide member 12, as shown in FIGS. 6 and 7.

At this time, the protrusion 174 collides with the outer surface of the guide member 12, the elevating member 171 is pressed downward by the slope 174*a*, and thus the elastic member 175 is contracted. Therefore, the protrusion 174 descends, and the first door 40 is rotated after the protrusion 174 descends down to the lower surface of the guide member 12 according to the rotation of the first door 40, and then closes one side portion of the cooling chamber 20.

When the closing of the first door 40 is completed, the protrusion 174 is located in the guide slot 12*b* of the guide member 12. Then, due to the removal of the external force applied to the protrusion 174, the elastic member 175 is restored to its original state and the protrusion 174 ascends to the initial height when external force is not applied.

When the first door 40 is opened under the above condition, the protrusion 174 is guided along the guide slot 12*b*, and the filler unit 160 is rotated in the direction of the cooling chamber 20. Thus, the first door 40 is opened.

Therefore, even if the first door 40 is closed when the filler unit 160 provided on the first door 40 is rotated in the direction of the second door 50 due to the malfunction of the filler unit 160 or by a user, it is possible to prevent the breakage of the filler unit 160. This breakage could be due to the collision of the protrusion 174 with the guide member 12, and the protrusion 174 of the protection unit 170 descends and facilitates the closing of the first door 40. This prevents the leakage of cold air in the cooling chamber 20 to the outside due to the incomplete closing of the cooling chamber 20.

Hereinafter, a refrigerator in accordance with a further embodiment of the present invention will be described.

Figure 9:
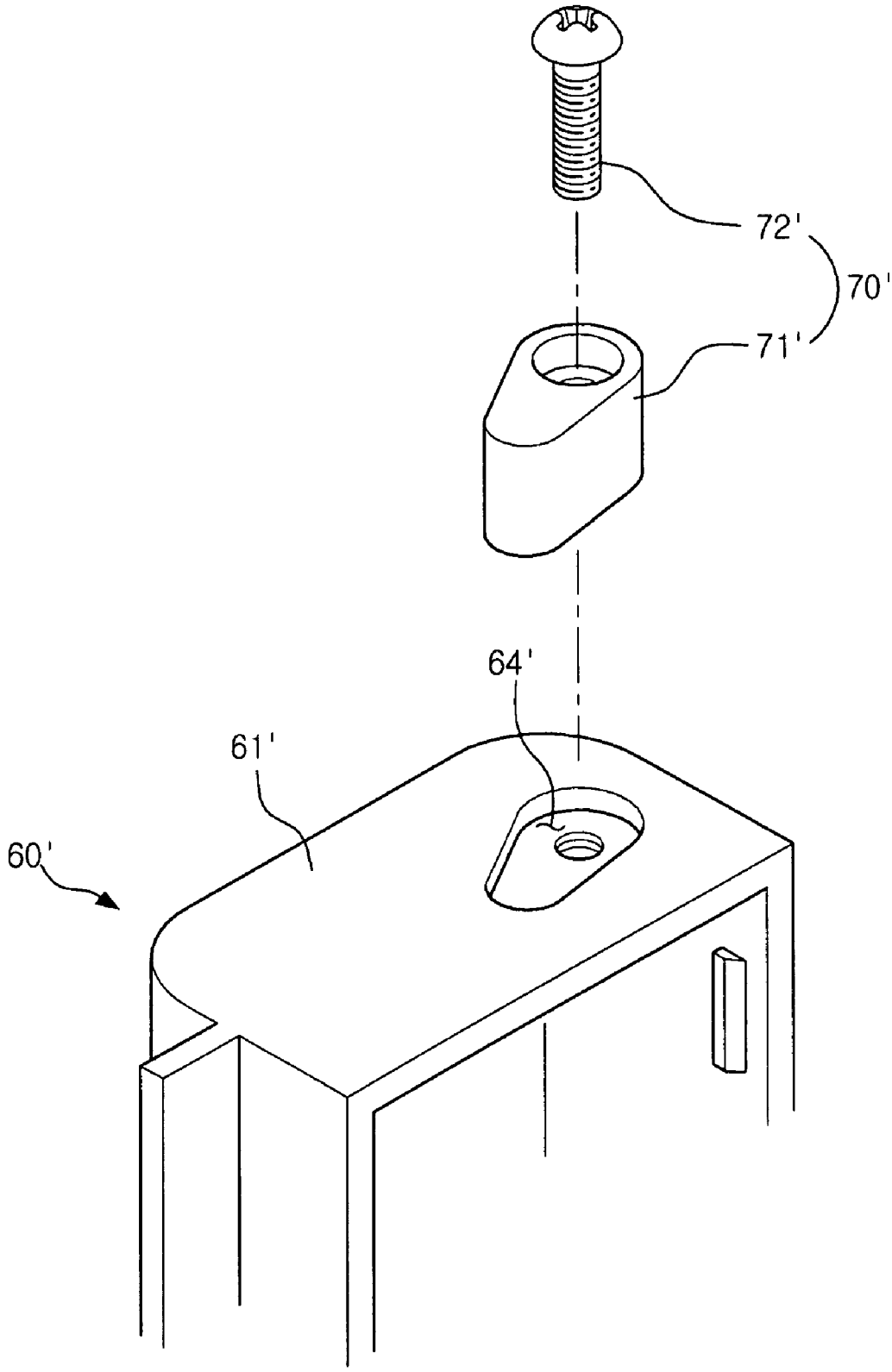
FIG. 9 is an enlarged view of an essential portion of a refrigerator in accordance with a further embodiment of the present invention.
Figure 10:
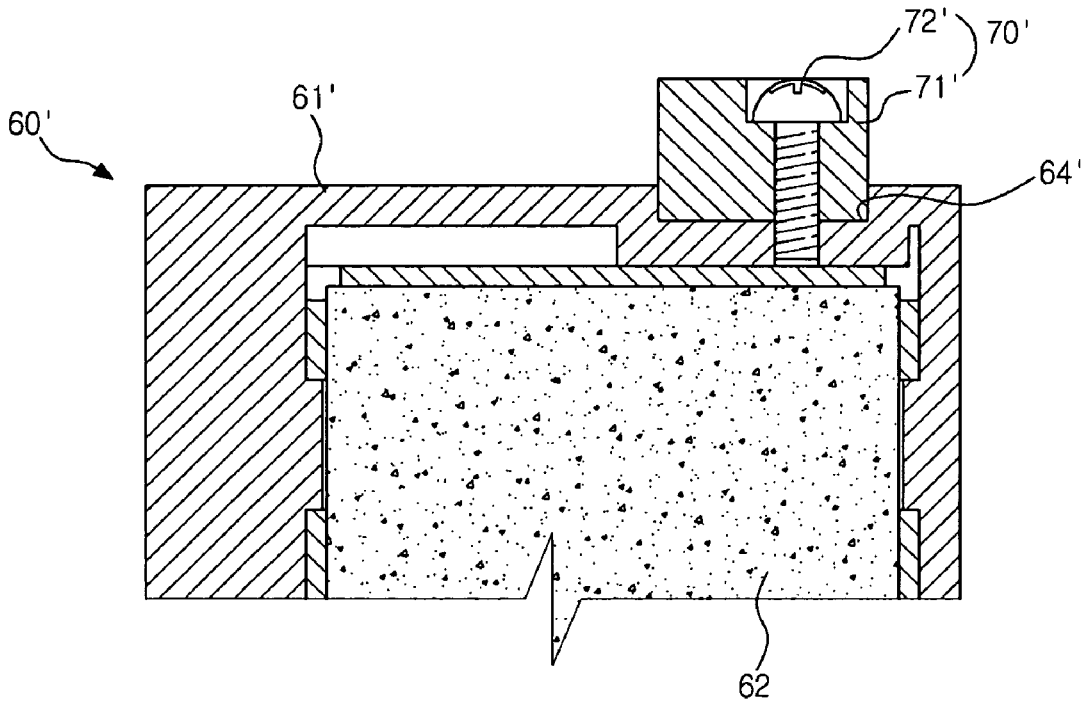
FIG. 10 is a sectional view illustrating the connection state of a filler unit and a protection unit of the refrigerator in accordance with the embodiment of the present invention.

FIG. 9 is an enlarged view of an essential portion of the refrigerator in accordance with this embodiment, and FIG. 10 is a sectional view illustrating the connection state of a filler unit and a protection unit of the refrigerator in accordance with this embodiment.

Parts of the refrigerator in this embodiment are the same as those of the refrigerator in the former embodiment shown in FIGS. 1 to 5 except for some parts of the filler unit and the protection unit.

Hereinafter, only parts in this embodiment, which differ from those in the former embodiment shown in FIGS. 1 to 5, will be described. Parts in this embodiment, which are substantially the same as those in the former embodiment shown in FIGS. 1 to 5, are denoted by the same reference numerals and a detailed description thereof will thus be omitted.

The refrigerator in accordance with this embodiment, as shown in FIGS. 9 and 10, further includes a filler unit 60' sealing a separation space between a pair of cooling chamber doors 40 and 50. Thus, the filler unit 60' prevents the leakage of cold air in a cooling chamber 20 to the outside. The refrigerator also includes a protection unit 70' mounted on the filler unit 60' to rotate the filler unit 60' according to insertion and separation of the protection unit 70' into and from a guide member 12 and to prevent the breakage of the filler unit 60' due to collision with the guide member 12.

A seat part 64', on which the protection unit 70' is mounted, is indented into an upper surface 61' of the filler unit 60'.

The protection unit 70' has a designated height so as to be inserted into and separated from the guide member 12, and includes a boss 71', a lower end of which is inserted into the seat part 64', and a screw 72' connecting the boss 71' to the filler unit 60'.

Through the above configuration, the mounting of the protection unit 70' on the filler unit 60' is completed by locating the boss 71' at the seat part 64' of the filler unit 60' and fixing the boss 71' to the seat part 64' using the screw 72'.

Therefore, the protection unit 70' mounted on the seat part 64' moves along an opening 12*a* and a guide slot 12*b* of the guide member 12, thus achieving the rotation of the filler unit 60'.

Even if the cooling chamber doors 40 and 50 are used for a long time under the above condition, the wear of the boss 71' is reduced due to the self-lubricating function of the boss 71'. Further, although the boss 71' is worn away or broken due to extended use, or is broken due to the collision of the boss 71' with the outer surface of the guide member 12, when the filler unit 60' is rotated in the direction of the second door 50, the worn or broken boss 71' is separated from the seat part 64'. This is achieved by loosening the screw 72' and then a new boss 71' is fixed to the seat part 64' using the screw 72'. Thus, replacement of the entire filler unit 60' is not required, and the durability of the filler unit 60' may be improved.

The above-described refrigerator prevents the breakage of the filler unit when a door is abnormally opened and closed, and thus improves the durability of the filler unit.

Further, the refrigerator has the cover provided on the outer surface of the protrusion to protect the protrusion and thus prevents the breakage of the filler unit, and, when the cover is broken, requires the replacement of only the cover, to reduce a cost to replace the filler unit.

Although embodiments of the invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body;

a plurality of storage chambers in the main body;

a pair of doors opening and closing one of the storage chambers;

a filler unit rotatably connected to at least one of the pair of doors to seal a separation space between the pair of doors;

a guide member on the main body to guide rotation of the filler unit;

a protection unit on the filler unit to rotate the filler unit according to insertion and separation of the protection unit into and from the guide member and to prevent breakage of the filler unit due to collision with the guide member; and a protrusion formed integrally with one side of the filler unit, wherein the protection unit includes a cover to surround an outer surface of the protrusion.

2. The refrigerator according to claim 1, wherein the cover is detachably connected to the protrusion.

3. The refrigerator according to claim 1, wherein the protection unit further includes a screw to detachably connect the cover to the protrusion.

4. The refrigerator according to claim 1, wherein the cover is made of a material having a self-lubricating function.

* * * * *